United States Patent [19]

Lorimor

[11] 4,141,280

[45] Feb. 27, 1979

[54] DUAL PUMP FLOW COMBINING SYSTEM

[75] Inventor: Larry W. Lorimor, Joliet, Ill.

[73] Assignee: Caterpillar Tractor Co., Peoria, Ill.

[21] Appl. No.: 814,259

[22] Filed: Jul. 11, 1977

[51] Int. Cl.[2] ..... F15B 13/04

[52] U.S. Cl. ..... 91/29; 60/428; 60/486; 137/596.13

[58] Field of Search ..... 91/28, 29, 6; 60/428, 60/430, 486; 137/596.13

[56] References Cited

U.S. PATENT DOCUMENTS

| | | | |
|---|---|---|---|
| 2,728,194 | 12/1955 | Clark et al. | 60/430 |
| 3,064,426 | 11/1962 | Furia et al. | 91/28 |
| 3,386,344 | 6/1968 | Junck et al. | 91/532 |
| 3,535,877 | 10/1970 | Becker et al. | 60/422 |
| 3,847,180 | 11/1974 | Kroth et al. | 91/451 X |
| 3,969,985 | 7/1976 | Grieger et al. | 91/416 |

*Primary Examiner*—Irwin C. Cohen
*Attorney, Agent, or Firm*—John W. Grant

[57] ABSTRACT

A first control valve of a fluid circuit connecting a first pump to a fluid motor has a signal port in communication with an inlet port when the first control valve is at a selected position at which substantially the total output of the first pump is directed to the motor. A valve device connects a second pump to the fluid circuit in response to a valve spool of the first control valve being moved to said selected position. The valve device has a valve member movable between a first position at which the second pump is in communication with a tank and a second position at which the output of the second pump is combined with the output of the first pump in the fluid circuit. A device moves the valve member to the second position in response to the valve spool of the first control valve being moved to said selected position. The device includes first and second actuation devices associated with the first and second ends of the valve member. The first actuation device has a first preselected area and a first chamber in communication with the first signal port. The second actuation device has a second preselected area greater than the first preselected area of the first actuation device and a second chamber in communication with the signal port.

6 Claims, 1 Drawing Figure

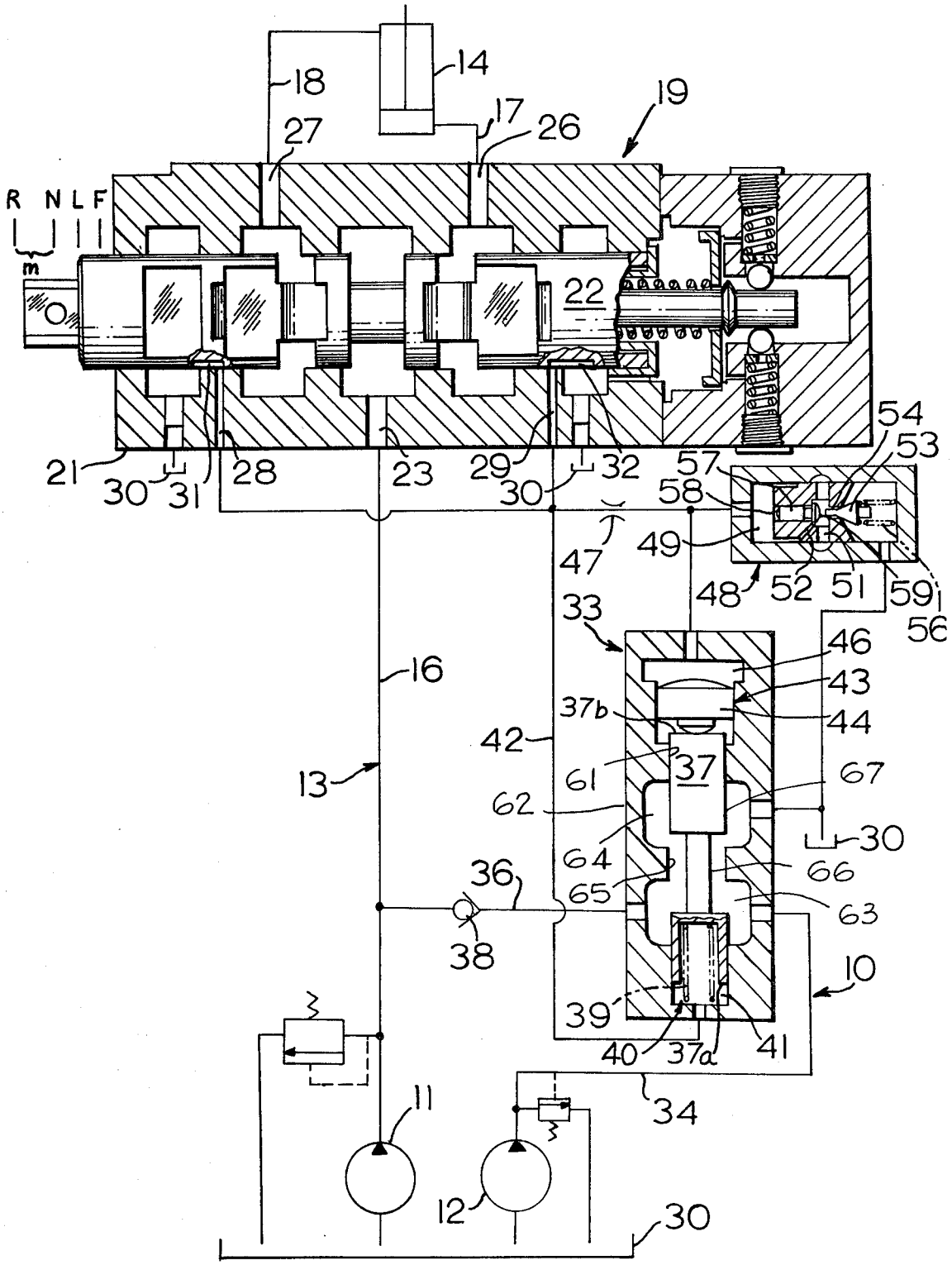
14
18
17
26
19
27
R N L F
m
22
21
30
31
28
23
29
32
30
57
54
53
58
49
47
48
52
51
59
56
33
46
43
37b
44
42
61
37
67
13
62
30
64
66
36
65
63
38
10
39
40
37a
41
34
11
12
30
16

DUAL PUMP FLOW COMBINING SYSTEM

BACKGROUND OF THE INVENTION

Many hydraulic systems have a large capacity pump as the primary source of fluid for several control valves, each of which controls fluid flow to one or more fluid motors. In some systems, a smaller capacity pump is also provided to supplement the output of the larger pump when the fluid pressure of the system is below a predetermined magnitude. One of the problems encountered with such systems is that although the output of the small pump generally is needed for only the motor or motors controlled by one control valve or for only a small percentage of the time the output of both pumps passes through the control valves all the time that the fluid pressure is below the predetermined magnitude. This causes additional problems particularly when fluid flow to the motors is being modulated by the control valves since the control valves must then modulate the total output of both pumps.

The Applicant of the present application is aware of one system which solves the above problem. Such system has a fluid circuit which connects a first pump to a fluid motor and has a control valve for controlling fluid flow from the first pump to the motor. The control valve has an inlet port connected to the pump, a motor port connected to the motor, and a valve spool movable between a first position at which the inlet port is blocked from communication with the motor port, a second position at which fluid flow from the inlet port to the motor port is controllably modulated and a third position at which substantially the total output of the first pump passes from the inlet port to the motor port. The second pump is connected to the fluid circuit through a combining valve in response to the valve spool being moved to the third position. At the third position of the valve spool, fluid pressure is directed from the signal port to a signal chamber of the combining valve to move a valve member to an actuated position while a spring returns the valve member to the nonactuated or noncombining position when the signal chamber is vented. However, it has been found in practice that it is desirable to at least have the capability under some operational conditions of moving the valve member in both directions by fluid pressure in case the valve member should stick.

SUMMARY OF THE INVENTION

The present invention is directed to overcoming one or more of the problems as set forth above.

A dual pump flow combining system has first and second pumps, a double acting fluid motor and a fluid circuit connecting the first pump to the motor. The fluid circuit has a first control valve for controlling fluid flow therethrough from the first pump to the motor. The first control valve has an inlet port connected to the pump, a motor port connected to the motor, and a valve spool movable between a first position at which the inlet port is blocked from communication with the motor and signal port, and a second position at which substantially the total output of the first pump passes through the first control valve from the inlet port to the motor port and the inlet port is in communication with said signal port. A valve means is connected to said second pump and to said fluid circuit and has a valve member having first and second ends. The valve member is movable between a first position at which the second pump is in communication with a tank and a second position at which the output of the second pump is combined with the output of the first pump in the fluid circuit. A first means is provided for moving the valve member to the second position in response to the valve spool of the first control valve being moved to said second position. The first means includes a first actuation means associated with the first end of the valve member and has a first preselected area and a first chamber in communication with the signal port. A second actuation means is associated with the second end of the valve member. The second actuation has a second preselected area greater than the first preselected area of the first actuation means and a second chamber in communication with the signal port.

BRIEF DESCRIPTION OF THE DRAWING

The sole FIGURE is a diagrammatic view of the apparatus of this invention.

DETAILED DESCRIPTION

Referring to the drawing, a dual pump flow combining system is generally indicated at 10 for selectively combining the fluid output of first and second pumps 11, 12 driven by an engine, not shown. A fluid circuit 13 connects the first pump to a fluid motor 14 and includes conduits 16–18 and a valve means 19.

The valve means 19 can be, for example, a directional control valve 21 which controls fluid flow from the first pump 11 to and from fluid motor 14. The control valve 21 has a valve member or spool 22 which is shown at a neutral or centered position indicated by the letter "N". At this position, an inlet port 23 is blocked from communication with a pair of motor ports 26, 27 connected to the conduits 17, 18, respectively. The valve spool 22 is movable to the left as viewed in the drawing between the centered position and a fully actuated position indicated by the letter "R". At this position, the inlet port 23 is in communication with the motor port 26 sufficient for the total output of the first pump 11 to be directed through the motor port 26 and to the head end of the fluid motor 14. The fluid motor can be connected to an earthworking tool or the like so that directing fluid to the head end raises the tool. The valve spool 22 is movable to a plurality or range of modulating positions intermediate the centered position and the fully actuated position. At the modulating positions, indicated by the letter "m", fluid flow from the inlet port 23 to the motor port 26 is controllably modulated with the amount of fluid passing from the inlet port 23 to the motor port 26 progressively increasing as the valve spool moves from the centered position to the fully actuated position. The valve spool can also be moved to the right from the centered position to another fully actuated position indicated by the letter "L". At this position the inlet port 23 is in communication with the motor port 27 sufficient for the total output of the first pump 11 to be directed through the motor port 27 to the rod end of the fluid motor. A plurality or range of modulating positions also are provided intermediate the "N" and "L" positions of the spool.

The control valve 21 has a pair of signal ports 28, 29 which are connected with a tank 30 through slots 31, 32 respectively in the valve spool 22 at the centered position and substantially all the modulating positions of the valve spool. When the valve spool is moved from the modulating position to the "R" position, the signal port 29 is communicated with the motor port 26 through the slot 32. The signal port 29 and slot 32 are preferably positioned so that as the valve spool 22 is moved to the left, communication between the motor port 26 and signal port 29 through the slot 32 is established when the valve spool reaches the position "R" at which substantially the total output of the first pump 11 passes from the inlet port 23 to the motor port 26. Also, the signal port 28 and slot 31 is preferably positioned so that as the valve spool 22 is moved to the right, communication between the motor port 26 and the signal port 28 through the slot 31 is established when the spool reaches the position "L" at which substantially the total output of the first pump 11 passes from the inlet port 23 to the motor port 27. Moreover, the signal port 28 and slot 31 are preferably positioned so that as the spool is moved to the left, the signal port 28 is blocked from communication with the slot 31 before the spool reaches the modulating positions. Likewise, the signal port 29 and slot 32 are preferably positioned so that as the spool is moved to the right, the signal port 29 is blocked from communication with the slot 32 before the spool reaches the modulating positions.

A valve means 33 has a valve member 37 slidably positioned within a bore 61 of a housing 62. A first annulus 63 is connected to the second pump 12 through a conduit 34 and to the conduit 16 through a conduit 36. A second annulus 64 is separated from the first annulus 63 by a land 65 and is connected to tank 30. Valve member 37 is movable between a first and a second position. At the first position, an annular groove 66 in the valve member connects annulus 63 with annulus 64 so that the second pump 12 is in communication with the tank. At the second position, a land 67 cooperates with the land 65 to block communication between annuli 63 and 64 so that the second pump is blocked from the communication with the tank. Thus, at the second position of the valve member the output of the second pump 12 is combined with the output of the first pump 11. A check valve 38 is positioned in the conduit 36 for preventing fluid from passing from the conduit 16 to the valve means 33.

A means move the valve member 37 to the second position in response to the valve spool 22 being moved to the second position. The means can include a first actuating means 40 and second actuating means 43. First actuating means 40 is positioned at and is associated with a first end 37*a* of the valve member and can be the first end 37*a*, and a biasing means, for example a spring 39, positioned in a chamber 41 at one end of the valve member. The spring urges the valve member to the first position. The chamber 41 is connected to the signal ports 28, 29 through a signal line 42. The first end of the valve member has a first preselected area.

The second actuating means 43 is positioned at and associated with a second end 37*b* of the valve member 37 and has a piston 44 slidably positioned within a signal chamber 46. The piston is in abutment with the second end of the valve member and has a second preselected area greater than the first preselected area of the first end 37*a* of the valve member. The signal chamber 46 is connected to the signal line 42 through an orifice 47. Alternatively, the piston 44 can be formed on the second end of the valve member as an integral part thereof.

An unloading valve assembly 48 has a chamber 49 connected to the signal line 42 through the orifice 47. Another chamber 51 is connected to chamber 49 through a flow restrictor or orifice 52. The orifice 52 is preferably larger than the orifice 47. A poppet valve 53 is positioned for blocking a passage 54 connected to the chamber 51. The poppet valve is movable between a closed position at which the chamber 51 is blocked from communication with the tank 30 and an opened position at which chamber 51 is in communication with the tank through passage 54. A spring 56 biases the poppet valve to the closed position and is of a size sufficient for allowing the poppet valve to move to its opened position in response to the fluid pressure in chamber 51 exceeding a preselected magnitude.

A piston 57 is slidably positioned within a bore 58 having an open end in communication with the chamber 49. An enlarged head portion 59 of the piston is disposed within the chamber 51 adjacent the inner end of the poppet valve 53.

In the operation of this apparatus, with valve spool 22 of control valve 21 in either the centered or modulating positions, one of the signal ports 28, 29 is in communication with the tank thereby venting chambers 41, 46 to the tank. With both chambers 41, 46 vented, the spring 39 biases the valve member 37 to the first position shown.

Moving the valve spool 22 from the modulating position to its fully actuated position "R" establishes communication between the motor port 26 and signal port 29 through the slot 32. Pressurized fluid rom the motor port passes through signal line 42 to the chamber 41 and through the orifice 47 to the chamber 46. Since the second preselected area of the piston 44 is greater than the first preselected area of the first end 37*a* of valve member 37, the valve member is moved to its second position. At the second position of the valve member, the output of the second pump 12 is combined with the output of the first pump 11 in the conduit 16. Likewise, moving the valve spool 22 to the "L" position causes pressurized fluid to be directed into signal line 42 for moving the valve member 37 to the second position.

With the valve spool 22 in either the "R" or "L" position, pressurized fluid from line 42 enters the chamber 49. Fluid from chamber 49 then passes through the orifice 52 into chamber 51. Should the fluid pressure in the fluid circuit 13 and thus the signal line 42 and chambers 41, 46, 49 and 51 exceed a preselected magnitude, the fluid pressure in chamber 51 unseats the poppet valve 53 thereby communicating chamber 53 with the tank. This also vents chambers 49 and 46 through the orifice 52 and establishes a pressure differential across orifice 47. With chamber 46 vented, the fluid pressure in chamber 41 then moves the valve member 37 to the first portion.

With chamber 51 vented to the tank, a pressure differential across the orifice 52 between chambers 49, 51 is also created. The higher fluid pressure in chamber 49 then moves the piston 57 into abutment with the poppet valve 53 holding the poppet valve in the opened position until the fluid pressure in the chamber 49 decreases to a second preselected magnitude at which time the poppet valve will be moved to its closed position by the spring 56.

Other aspects, objects and advantages of this invention can be obtained from a study of the drawings, the disclosure and the appended claims.

The embodiments of the invention in which an exclusive property or privilege is claimed are defined as follows:

1. In a dual pump flow combining system having first and second pumps; a double acting fluid motor; a fluid circuit connecting the first pump to the motor and having a first control valve for controlling fluid flow therethrough from the first pump to the motor, said first control valve having a first signal port, an inlet port connected to the first pump, a first motor port connected to the first pump, a first motor port connected to the motor, and a valve spool movable between a first position at which the inlet port is blocked from communication with the first motor port and the first signal port, and a second position at which substantially the total output of the first pump passes through the first control valve from the inlet port to the first motor port and the first motor port is in communication with the first signal port; and valve means connected to said second pump and to said fluid circuit, said valve means having a valve member having first and second ends and being movable between a first position at which the second pump is in communication with a tank and a second position at which the second pump is blocked from communication with the tank and the output of the second pump is combined with the output of the first pump in the fluid circuit, biasing means for urging the valve member to the first position, and first means for moving the valve member to the second position in response to the valve spool of the first control valve being moved to said second position; the improvement comprising:

said first means including first actuation means associated with said first end of the valve member, said first actuation means having a first preselected area and a first chamber in communication with the first signal port; and second actuation means associated with said second end of the valve member, said second actuation means having a second preselected area greater than the first preselected area of the first actuating means, and a second chamber in communication with the signal port; and means for reducing the fluid pressure in the second chamber independently of the fluid pressure in the first chamber for urging the valve member toward the first position in response to the fluid pressure in the first chamber.

2. The system of claim 1 wherein said reducing means includes means for venting said second chamber in response to the fluid pressure in the fluid circuit exceeding a preselected magnitude, and means for restricting fluid flow from the signal port to the second chamber and venting means in response to the second chamber being vented.

3. In a dual pump flow combining system having first and second pumps, a fluid motor, a fluid circuit connecting the first pump to the motor, and valve means connected to said second pump and to said fluid circuit, said valve means having a valve member having first and second ends and being movable between a first position at which the second pump is in communication with a tank, and a second position at which the second pump is blocked from communiction with the tank and the output of the second pump is combined with the output of the first pump in the fluid circuit, and first means for moving the valve member to the second position in response to receiving a fluid pressure signal from the fluid circuit, the improvement comprising:

said first means including first and second actuating means, said first actuating means being at said first end of the valve member and having a first fluid chamber and a first preselected area, said second actuating means being at said second end of the valve member and having a second fluid chamber, and a second preselected area greater than the first preselected area of the first actuating means;

a signal line connecting the fluid circuit to said first and second fluid chambers; and means for reducing the fluid pressure in the second chamber independently of the fluid pressure in the first chamber for urging the valve member toward the first position in response to the fluid pressure in the first chamber.

4. The system of claim 3 wherein said reducing means includes means for venting said second fluid chamber in response to the fluid pressure in the fluid circuit exceeding a preselected magnitude, said venting means being connected to said signal line, and means for restricting fluid flow through said signal line to said second chamber and said venting means in response to said second chamber being vented.

5. The system of claim 4 wherein said restricting means includes an orifice positioned in said signal line.

6. The system of claim 3 including biasing means for urging said valve member to the first position in the absence of fluid pressure in both the first and second chambers.

* * * * *